United States Patent [19]

Mackie

[11] Patent Number: 4,676,511

[45] Date of Patent: Jun. 30, 1987

[54] TARGET FOR USE IN A BALL GAME

[76] Inventor: Donald E. Mackie, North Ythsie, Tarves, Ellon, Aberdeenshire, Scotland, AB4 0LS

[21] Appl. No.: 812,221

[22] Filed: Dec. 23, 1985

[30] Foreign Application Priority Data

Dec. 28, 1984 [GB] United Kingdom ..... 8432718
Nov. 1, 1985 [GB] United Kingdom ..... 8526945

[51] Int. Cl.[4] ..... A63B 63/04

[52] U.S. Cl. ..... 273/376; 446/485; 273/407; 273/411

[58] Field of Search ..... 273/370, 372, 374, 378, 273/376, 1 E, 237, 238, 118 D, 371, 377, 407, 183 A; 446/485

[56] References Cited

U.S. PATENT DOCUMENTS 2,783,999 3/1957 Simjian ..... 273/374
3,117,783 1/1964 Reid ..... 273/376
4,232,866 11/1980 Pennachio ..... 273/374

*Primary Examiner*—Richard C. Pinkham
*Assistant Examiner*—Mary Ann Stoll Lastova
*Attorney, Agent, or Firm*—Ratner & Prestia

[57] ABSTRACT

Apparatus for use in playing a game, comprises a ball and a target. The target has on its surface objective areas to be struck by the ball. The target is in the form of an upstanding post and the objective areas are of equal size and disposed on opposite faces of the target.

The target includes indicator lights for denoting when an objective area has been struck by the ball. Each objective area is connected with a respective indicator light so that the objective area struck may be easily identified.

The objective areas each have a pressure-sensitive actuator, which operates the corresponding indicator light.

9 Claims, 28 Drawing Figures

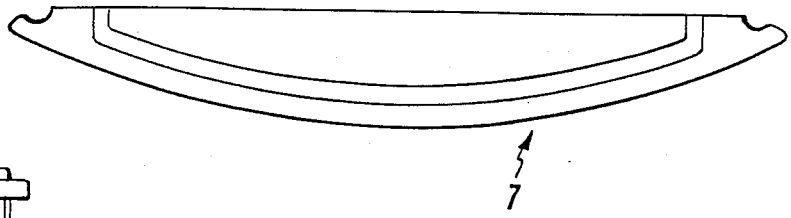
FIG. 12
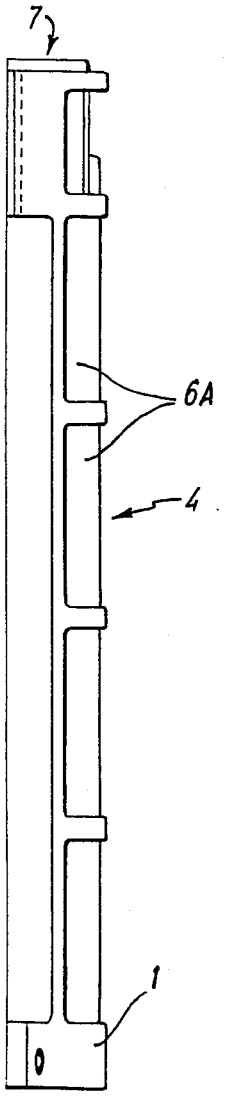
FIG. 11
FIG. 13
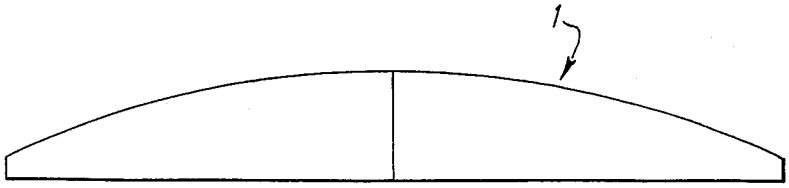

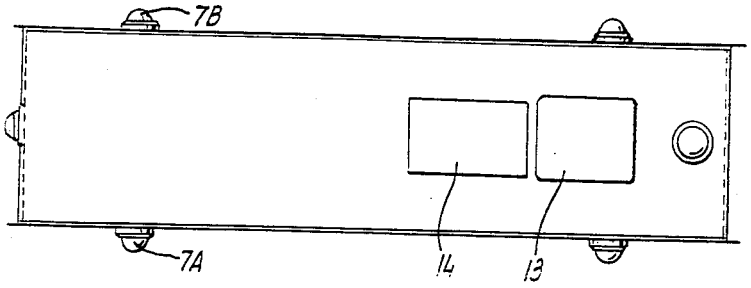
FIG. 26
FIG. 27
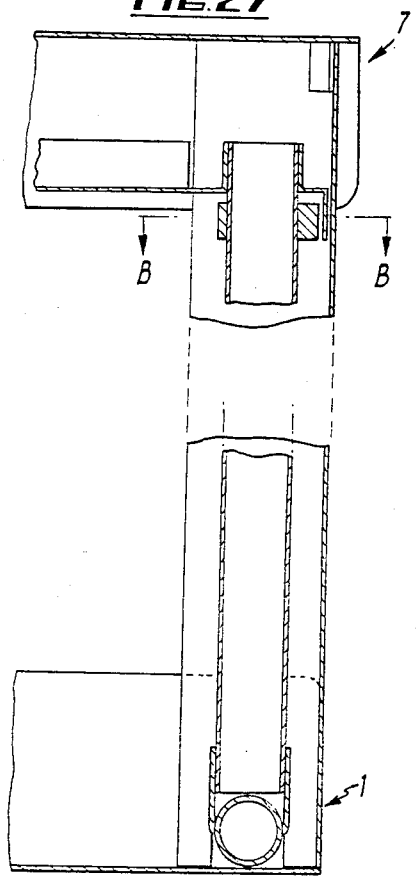
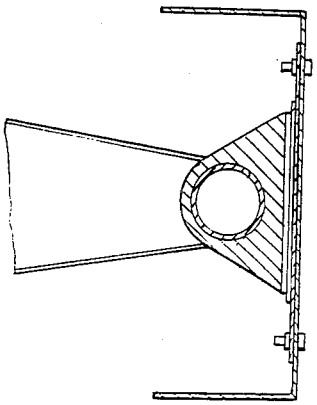
FIG. 28

TARGET FOR USE IN A BALL GAME

This invention relates to apparatus for use in playing a game.

According to the present invention there is provided apparatus for use in playing a game, comprising a ball and a target, the target having on its surface first and second mutually-distinguished areas each of which denotes an objective to be struck by the ball, the ball and target being used in accordance with rules hereinafter set forth.

The target is preferably in the form of an upstanding post although other forms may also be used. The objective areas are preferably of equal size and disposed on equivalent portions of the target; for example they may be provided on opposite faces of the target at equal heights and of equal extent.

The target may include indicator means for denoting when an objective area has been struck by the ball. Such indicator means may be visual or audible, an especially suitable form being one or more lights which are illuminated by switch means associated with the objective areas. Each objective area may be connected with a respective indicator means so that the objective area struck may be easily identified.

The indicator means may include a pressure-sensitive actuator, for example a pad covering the entire objective area.

Embodiments of the present invention will now be described by way of example with reference to the accompanying drawings in which:

FIG. 11 is a side view of the target of FIG. 10;

FIG. 12 is a top plan view of the target of FIG. 10;

FIG. 13 is a bottom plan view of the target of FIG. 10;

FIG. 26 is a sectional plan view of the target of FIG. 23 taken along line D—D;

FIG. 27 is a part cut away side sectional view to a different scale of the target of FIG. 23 taken along line A—A of FIG. 25; and FIG. 28 is a sectional detail view to a different scale of the target of FIG. 23 taken along line B—B of FIG. 27.

Figure 1:
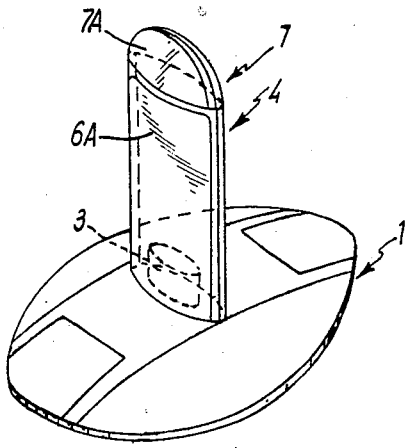
FIG. 1 is a perspective view of one embodiment of a target for use in the apparatus of this invention.
Figure 2:
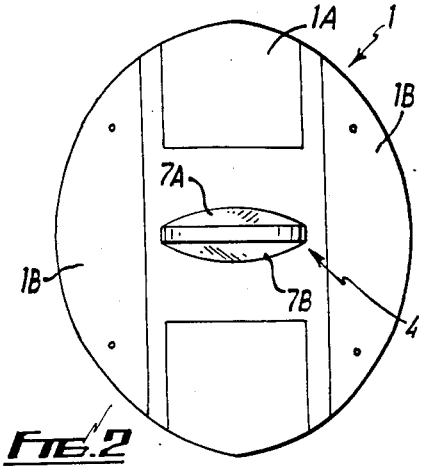
FIGS. 2, 3 and 4 are respectively a plan, side and front view of the target of FIG. 1.
Figure 3:
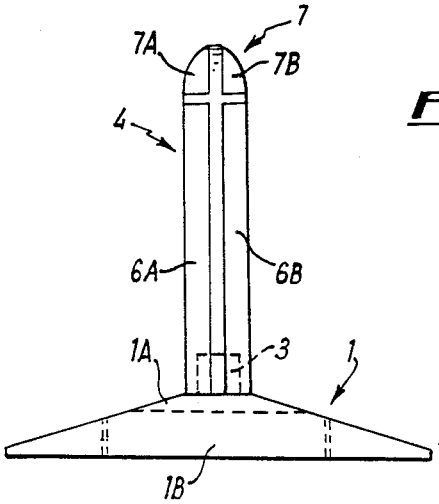
Figure 4:
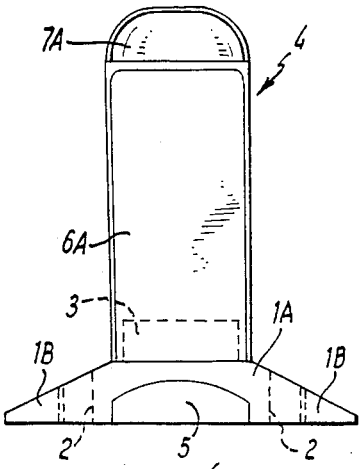

Referring to FIGS. 1 to 4 of the drawings, a first embodiment of a target comprises a base 1 having a central section 1A and side sections 1B which are hinged at 2 to the central section 1A. The base 1 has an upward stub projection 3 which fits within a corresponding recess in a lower portion of an upright post 4. The post is of generally elliptical cross-section, and can be removed from the stub projection 3 and stored within a recess 5 in the underside of the base 1, and enclosed therein by hinging the sections 1B of the base so as to lie below the central section 1A.

The opposed faces of the post 4 are formed by pressure-sensitive pads 6A, 6B which are differently colored, the pads 6A, 6B each providing a switch which completes a respective electrical circuit to actuate a buzzer and light disposed in an upper area 7 of the post. The lights 7A, 7B are differently colored, and the circuitry is powered by batteries.

The post 4 is 1.35m in height and the base is 1.05m in overall width and 1.25m in overall length.

A lightweight ball which actuates the pressure-sensitive pads 4 on striking them is also provided, and the game is played as follows:

The game can be played by 2, 4, 6 or 8 people split into opposing sides. The game commences at the beginning and after each goal by bouncing the ball off at a point approximately 10 meters from the post 4 along the midline of the post 4. Opposing teams then play as in football with the object being to score goals by kicking the ball against an appropriate one of the pressure-sensitive pads 6A, 6B to score a goal for one side or the other. The ball may not be handled by any player. An agreed time limit is set before each game and the team with most goals at the end of the period wins.

Figure 7:
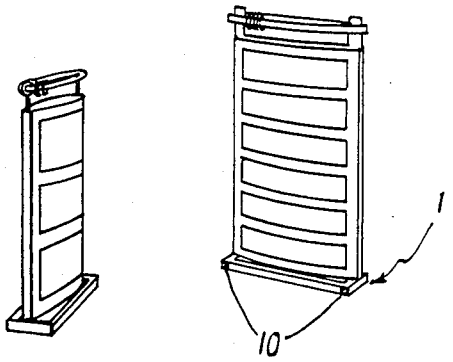
FIG. 7 is a perspective view showing two examples of a second embodiment of a target for use in the apparatus of this invention.
Figure 8:
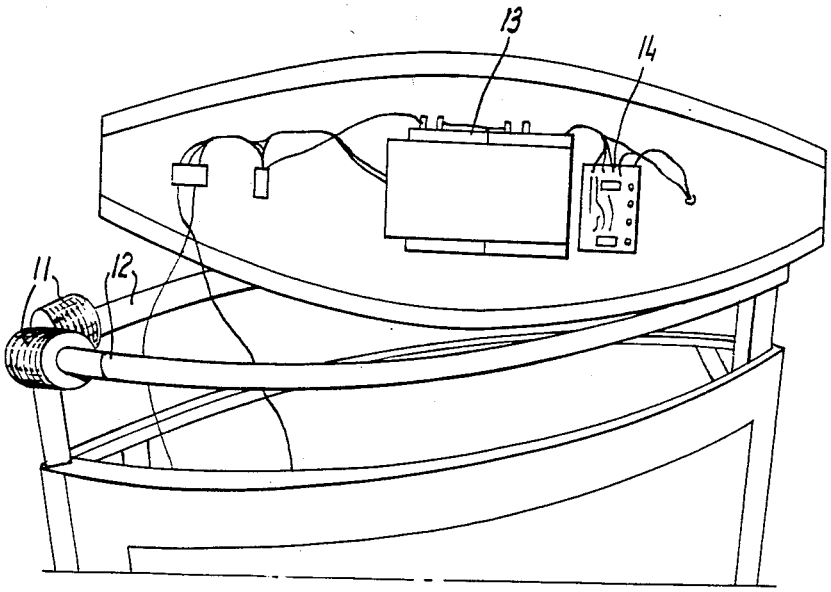
FIG. 8 is a perspective view showing the construction of part of one of the targets of FIG. 7.
Figure 9:
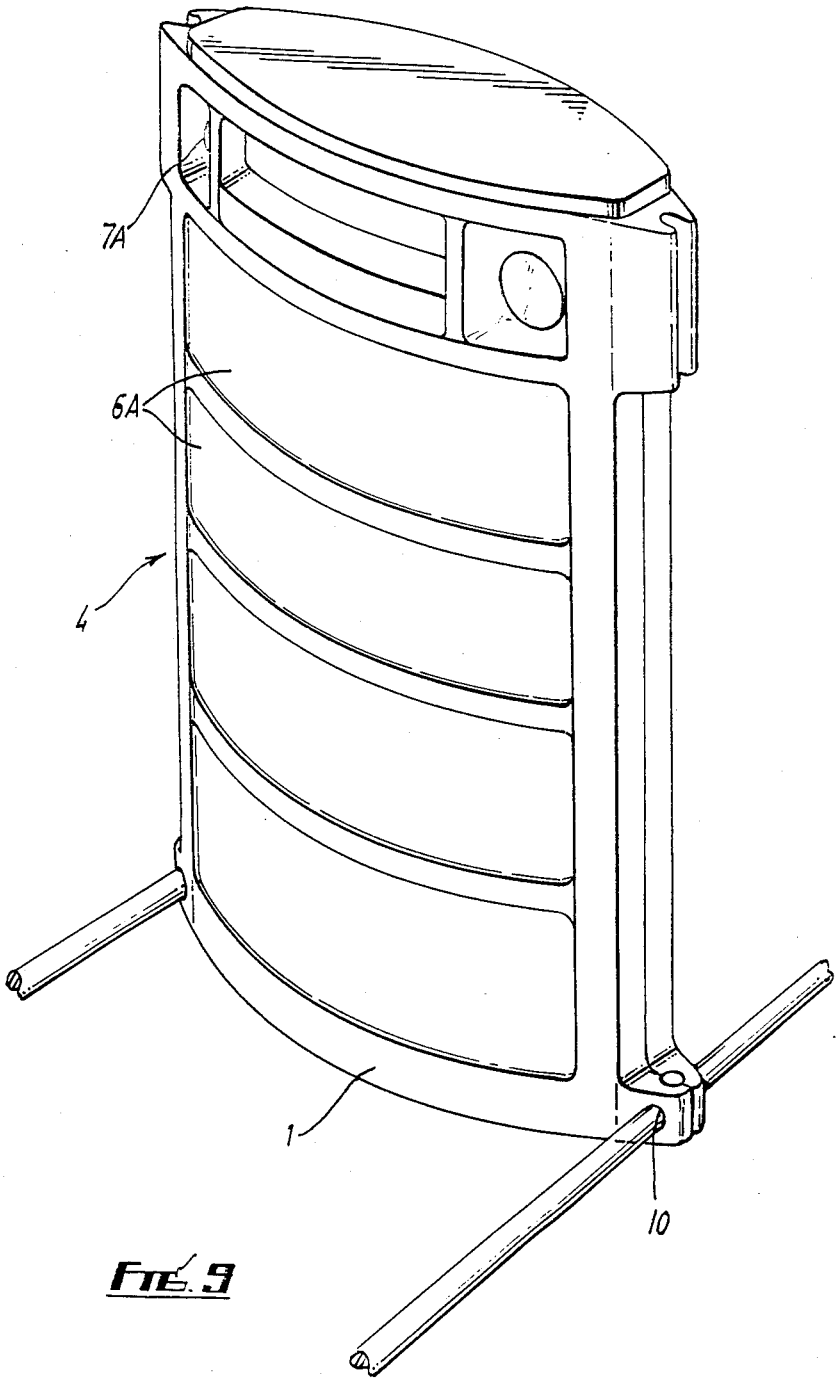
FIG. 9 is a perspective view of a third embodiment of a target for use in the apparatus of this invention.
Figure 10:
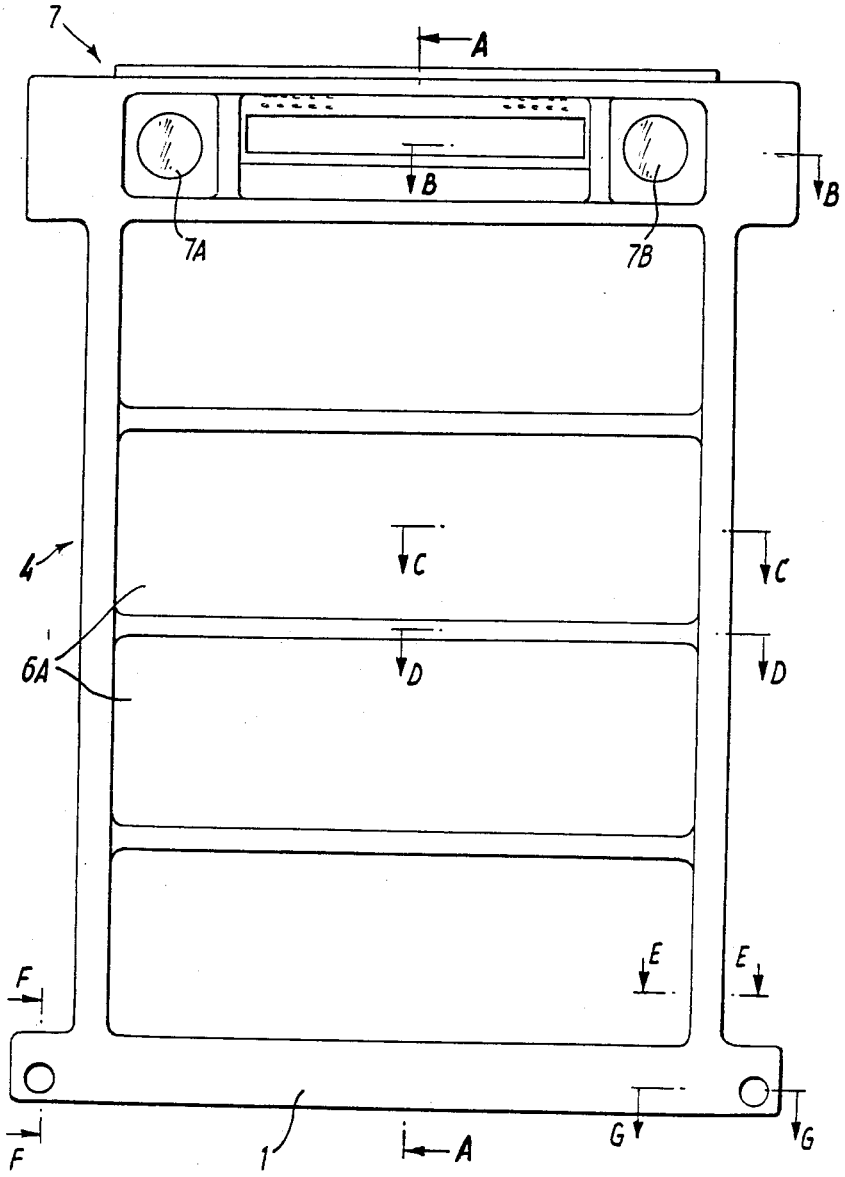
FIG. 10 is a front view of the target of FIG. 9.
Figure 14:
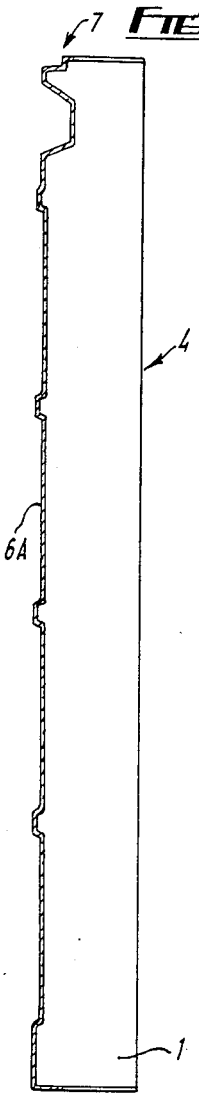
FIG. 14 is a sectional view of the target of FIG. 10 taken along line A—A.
Figure 15:
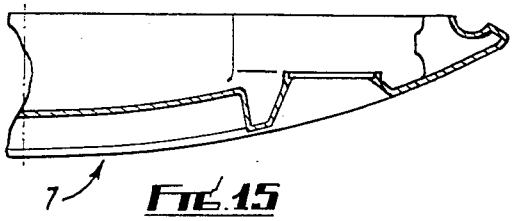
FIG. 15 is a sectional view of the target of FIG. 10 taken along line B—B.
Figure 16:
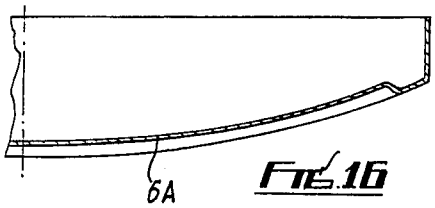
FIG. 16 is a sectional view of the target of FIG. 10 taken along line C—C.
Figure 17:
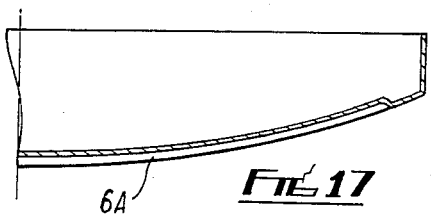
FIG. 17 is a sectional view of the target of FIG. 10 taken along line D—D.
Figure 18:
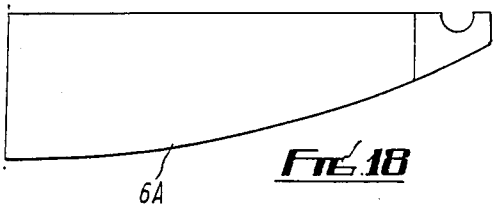
FIG. 18 is a sectional view of the target of FIG. 10 taken along line E—E.
Figure 19:
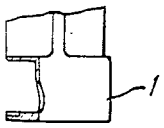
FIG. 19 is a sectional view of the target of FIG. 10 taken along line F—F.
Figure 20:
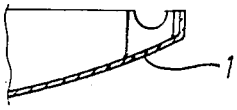
FIG. 20 is a sectional view of the target of FIG. 10 taken along line G—G.

Referring to FIGS. 7 and 8 of the drawings a second embodiment of a target is illustrated. This is similar to the embodiment described above but has smaller overall dimensions for ease of portability. In addition instead of a solid base the post 4 is supported by poles, not shown, which are inserted into sockets 10 on the base 1 of the target. A series of discs 11 mounted on runners 12 can be used as score indicators. The layout of batteries 13 and electronic circuits 14 is illustrated in FIG. 8.

The overall height of the target is 0.95m with the height to the top of the pressure sensitive pads 0.85m and the width 0.64m. The base is 0.20m deep and the post 0.17m deep. The base support poles are formed from 30mm box section metal and are 0.85m long.

The faces of the post forming the objective or target areas are each formed by 22 guage sheet metal each covered with a pair of security alarm pads. These pads comprise a foam layer with 10mm diameter holes cut out at approximately 20mm from each other. The foam layer is enclosed between two aluminium foil backed sheets attached to wires.

This composite structure is enclosed in a sealed plastic envelope which leaves two wires extending.

The pads are fixed to the post by double sided adhesive tape. The two sides are distinguished using colored adhesive carpet backing tape.

Figure 5:
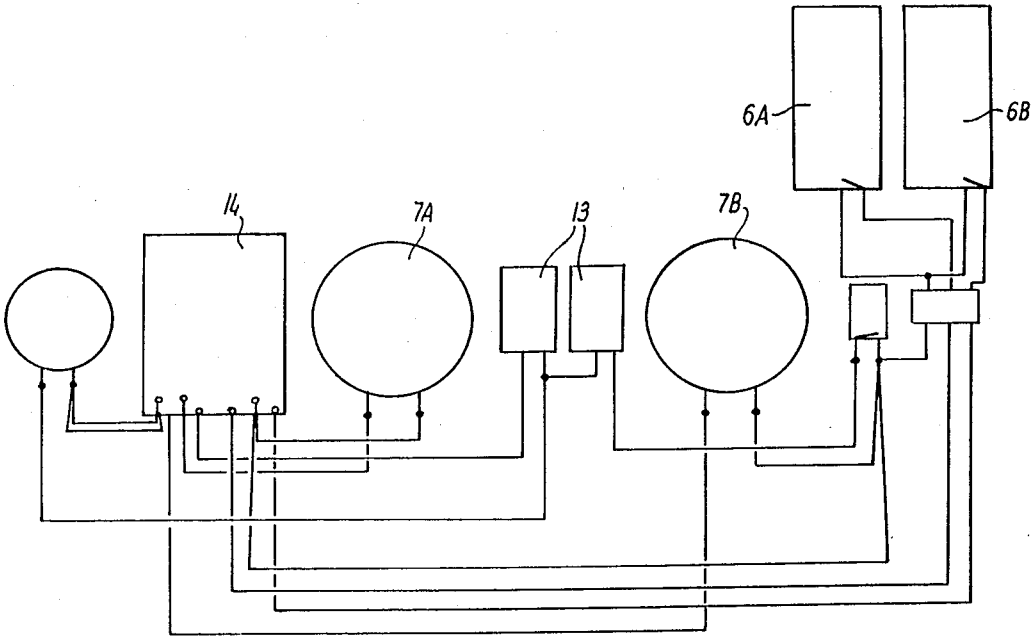
FIG. 5 is a schematic circuit diagram of a target.
Figure 6:
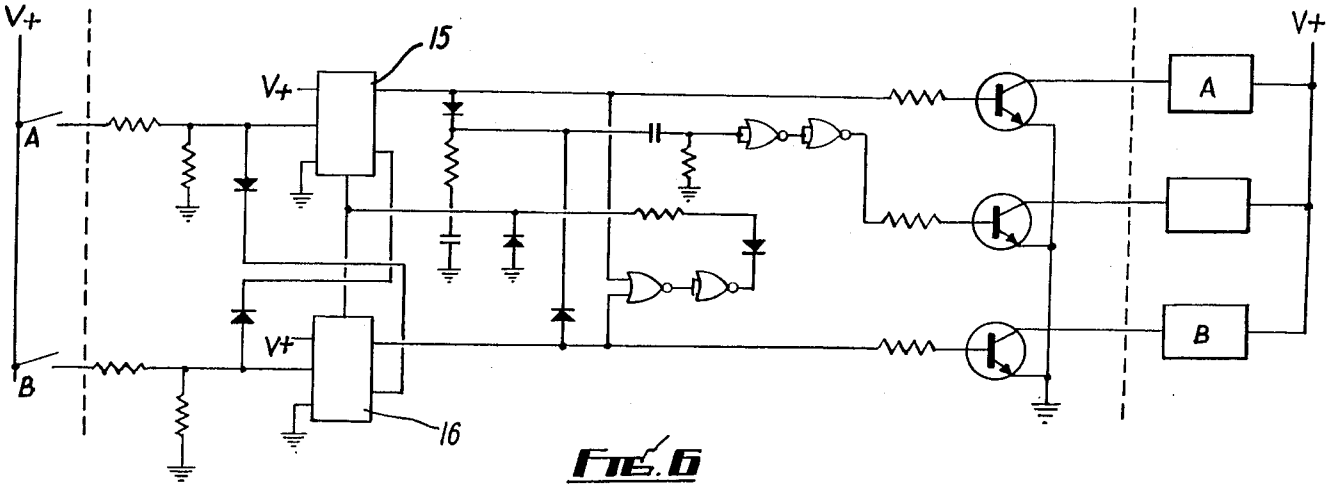
FIG. 6 is a circuit diagram of a scoring indicator circuit of a target.

FIGS. 5 and 6 illustrate the basic electronic circuitry of the target. When one side of the post is hit by the ball there is a reduction in resistance between the controls of the pad A or B (FIG. 6) on that side. The reduction in resistance is detected by circuit 15 or 16 and the appropriate light A or B is illuminated and the siren operated. The light A or B is illuminated in each case for a period longer than that during which the siren sounds. While either light is on the circuit will not respond to either pressure pad. As a function check both lights are illuminated and the siren sounds when the power supply is switched on.

FIGS. 9–20 illustrate a third embodiment of a target. In this embodiment the base support poles consist of a pair of U-shaped metal poles which are resiliently biased into sockets on the base of the target. The U-shaped poles act as base supports and also define "no-go areas" during play. The poles are also designed to fold up around the sides and over the top of the post for transport and storage.

This embodiment is similar to that shown in FIGS. 7 and 8 but the post 4 has a modified upper area 7 which provides a neater construction.

Figure 21:
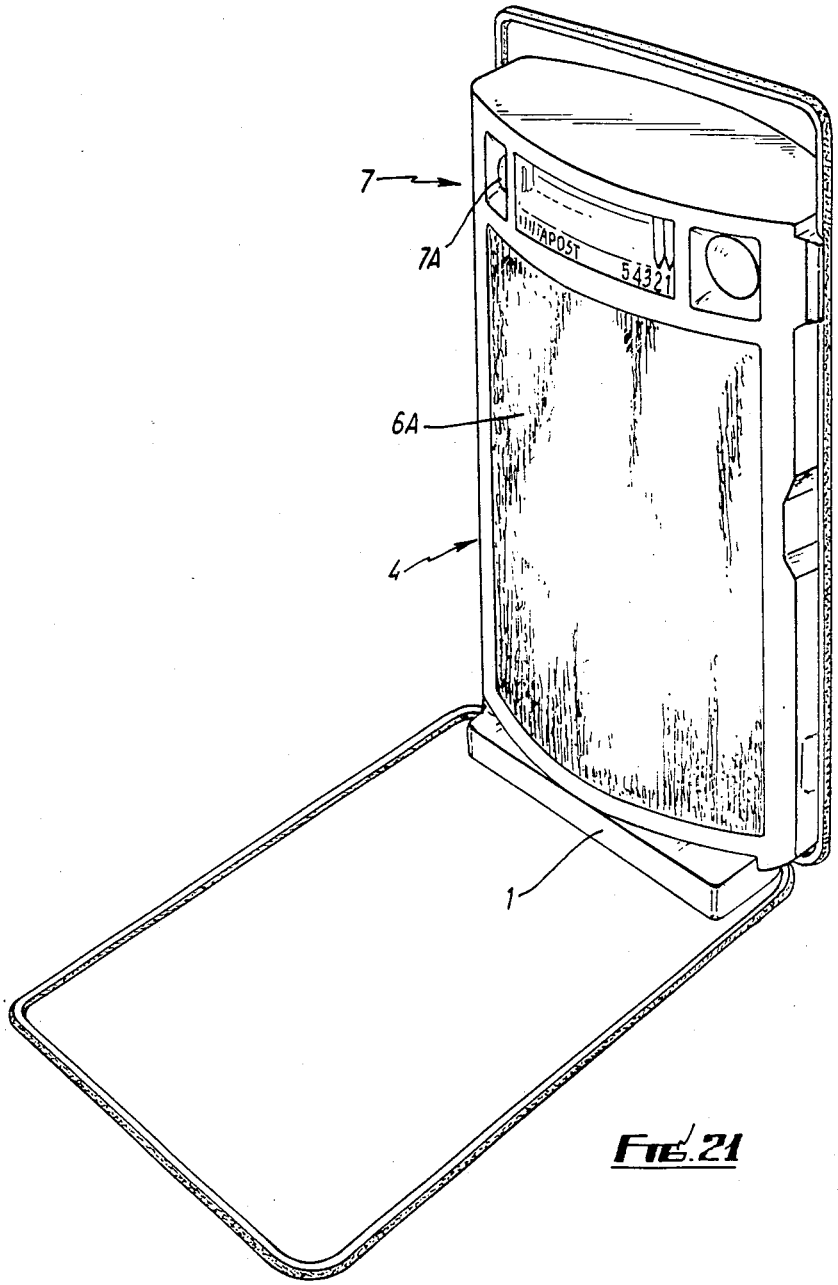
FIG. 21 is a perspective view of a fourth embodiment of a target for use in the apparatus of this invention.

FIG. 21 illustrates a fourth embodiment of a target. This embodiment is similar to that shown in FIGS. 9–20 but is of smaller overall dimensions. This embodiment is thus more easily portable than the previous embodiments. The base support poles also fold around the sides of the post 4 to form handles for ease of transportation.

Figure 22:
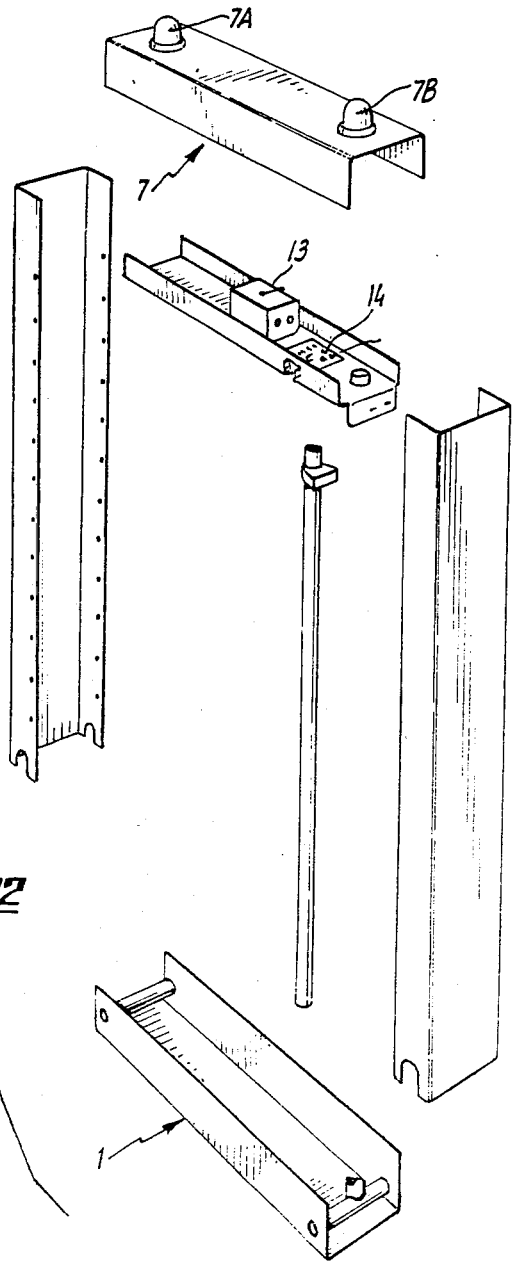
FIG. 22 is an exploded perspective view showing constructional details of a target.
Figure 23:
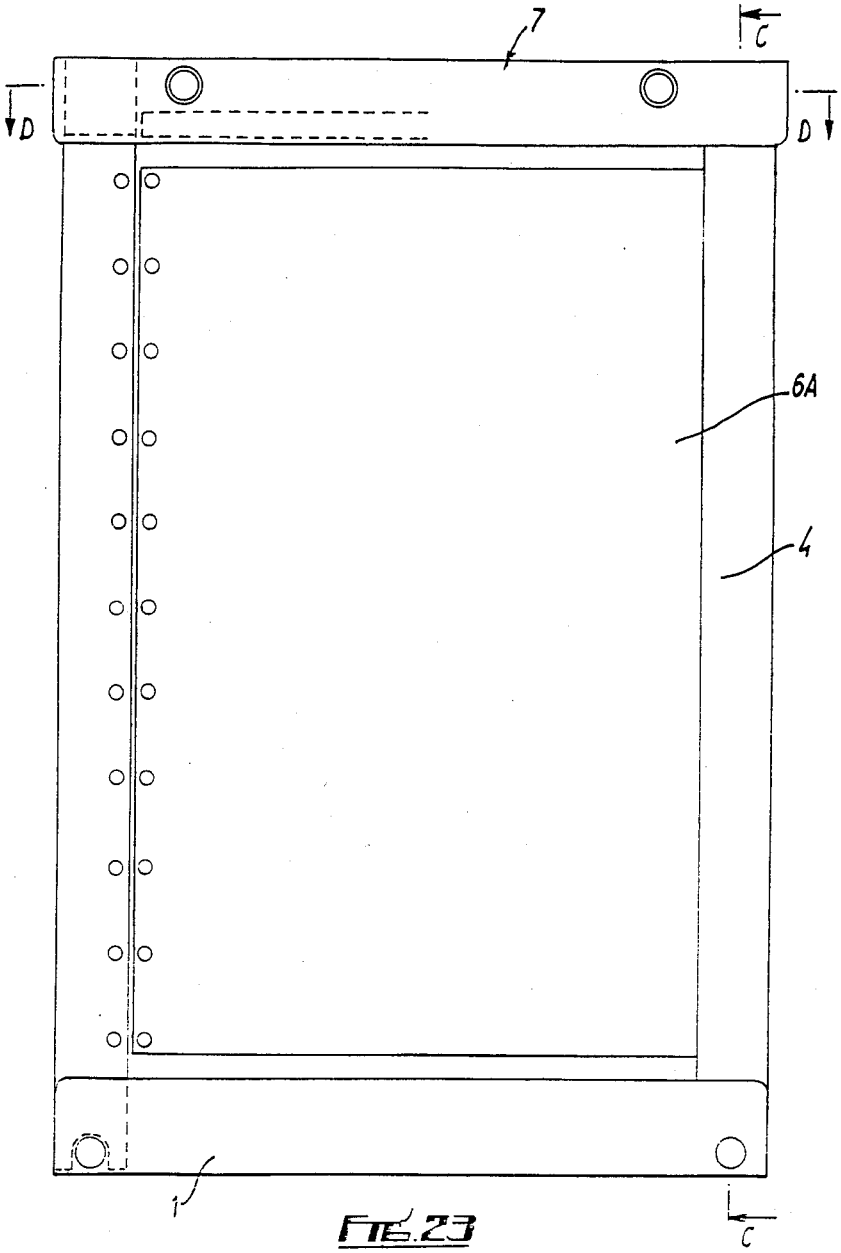
FIG. 23 is a front view of a further embodiment of a target for use in the apparatus of this invention.
Figure 24:
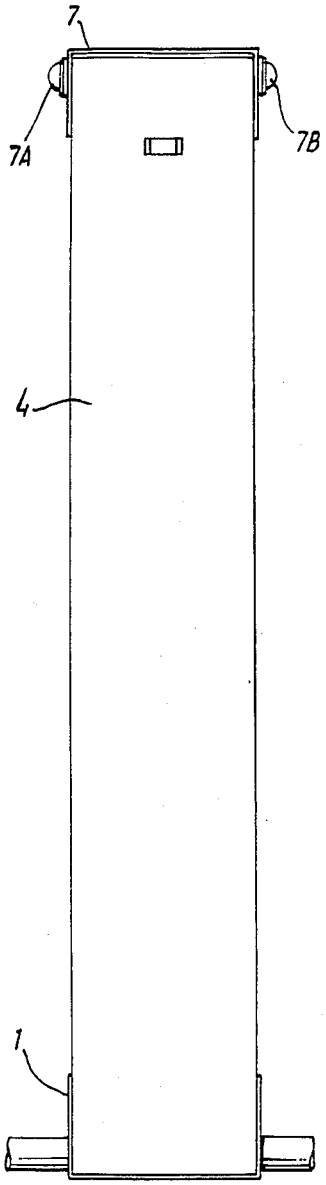
FIG. 24 is a side view of the target of FIG. 23.
Figure 25:
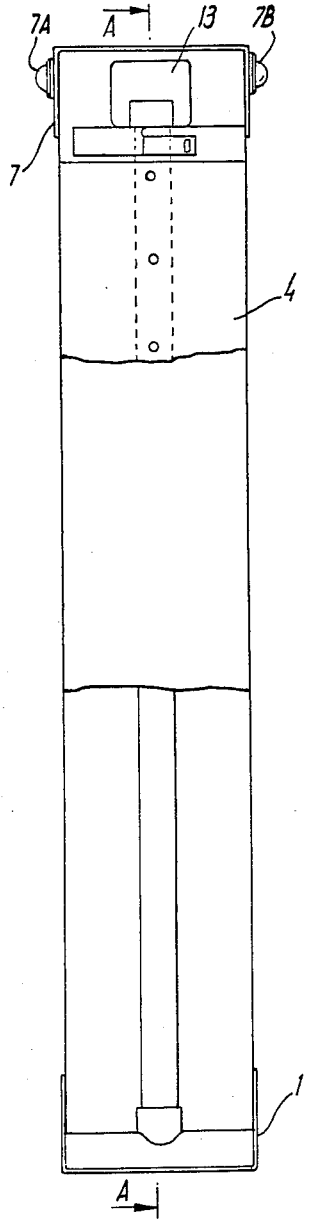
FIG. 25 is a sectional side view of the target of FIG. 23 taken along C—C.

FIG. 22 is an exploded perspective view illustrating a basic framework for a target. As can be seen the base 1, sides and upper area 7 are formed from steel channel sections to form a rigid framework for the target. The batteries 13 and electronic circuits 14 are also mounted on a similar steel channel section.

FIGS. 23–28 illustrate details of a further embodiment of a target. This target is identical in function to the earlier embodiments but differs in constructional details. The basic construction of this embodiment is similar to that illustrated in FIG. 22 with the base 1, sides and upper area 7 being formed from steel channel sections.

The pressure sensitive pads 6A and 6B extend between the side sections.

The embodiments illustrated are only by way of example.

Various modifications and additional features are also envisaged.

A number of alternative detecting means are possible. Examples of these are:

Microphones;
Vibration sensors;
Trip wires placed over the target areas;
Photo electric cells:
Nets to trigger microswitches;
Microswitches or magnetic reed switches triggered by initial ball contact on either face of the target;
Various proximity switches including the use of a 'special' ball to trigger the mechanism; and
Pneumatic 'air bag' switches.

Various types of indicators can also be used. Examples of these are various types of Standard filament bulbs;
Various gas filled bulbs;
Mechanical shutters, black to luminous yellow/red, for example;
No lights or colour indication at all, only noise;
Variations in timing of flashes etc; and
L.E.D./L.C.D. displays plus an automatic counter display.

The basic audible warning device may be supplemented or replaced by a bell, a whistle noise or a crowd cheering noise and the length of time for which the sound operates may be varied.

In addition to the embodiments described the target may be produced in a variety of different sizes for different applications. Such different applications may require the use of different materials. For example various different plastics or combinations of metal and plastics may be used.

The base may also be of plastics, metal or concrete as appropriate.

I claim:

1. Game apparatus comprising:

an upstanding target having a front face presented in a first direction and a rear face presented in a direction opposite to the front face;

first pressure-sensitive switch means associated with the front face which actuates upon application of pressure to the front face;

second pressure-sensitive switch means associated with the rear face which actuates upon application of pressure to the rear face;

electrical circuit means including said first and second switch means;

and electrical indicator means connected with the electrical circuit means, the indicator means being actuated on actuation of said first or second switch means.

2. Game apparatus as claimed in claim 1, wherein the said first pressure-sensitive switch means is arranged to actuate first indicator means and the second pressure-sensitive switch means is arranged to actuate second indicator means.

3. Game apparatus as claimed in claim 1, wherein the target comprises generally rectangular front and rear faces and relatively narrow side faces.

4. Game apparatus as claimed in claim 3, wherein each of said front and rear faces is convex.

5. Game apparatus as claimed in claim 3, wherein the target has a base from which extend forwardly and rearwardly ground-engaging supports.

6. Game apparatus as claimed in claim 1, wherein the front face and the rear face are of equal size and disposed on equivalent portions of the target.

7. Game apparatus as claimed in claim 1, wherein said indicator means are visual or audible.

8. Game apparatus comprising:

an upstanding target having a front face presented in a first direction and a rear face presented in a direction opposite to the front face, the front face and the rear face being resiliently movable towards each other;

first pressure-sensitive switch means actuable on movement of the front face towards the rear face;

second pressure-sensitive switch means actuable on movement of the rear face towards the front face;

electrical circuit means which is completed for passage of current on actuation of either said first switch means or said second switch means;

and electrical indicator means actuated on completion of said electrical circuit means to provide a visual or audible indication.

9. Game apparatus as claimed in claim 8, wherein the target is generally elliptical in horizontal cross-section, said front and rear faces forming the shallow arcuate portions of the ellipse, and a base is provided at a lower portion of the target having forwardly-extending and rearwardly-extending ground-engaging support thereby to render the target free-standing.

* * * * *